US006488791B1

(12) United States Patent
Powers, II

(10) Patent No.: US 6,488,791 B1
(45) Date of Patent: Dec. 3, 2002

(54) METHOD FOR STRENGTHENING A STEEL CHANNEL MEMBER

(75) Inventor: Buren K. Powers, II, Troutville, VA (US)

(73) Assignee: Metalsa Roanoke Inc., Roanoke, VA (US)

( * ) Notice: Subject to any disclaimer, the term of this patent is extended or adjusted under 35 U.S.C. 154(b) by 0 days.

(21) Appl. No.: 09/898,678

(22) Filed: Jul. 3, 2001

(51) Int. Cl.[7] ..... C21D 8/00

(52) U.S. Cl. ..... 148/647; 148/646; 148/654; 148/663; 148/651

(58) Field of Search ..... 148/575, 581, 148/584, 585, 645, 646, 647, 654, 663, 651

(56) References Cited

U.S. PATENT DOCUMENTS

| | | | |
|---|---|---|---|
| 3,252,695 | A | 5/1966 | Kuchera |
| 3,294,597 | A | 12/1966 | Kuchera |
| 4,142,923 | A | 3/1979 | Satava |
| 5,885,522 | A | 3/1999 | Giannini et al. |
| 5,968,293 | A | 10/1999 | Giannini et al. |
| 6,299,210 | B1 | 10/2001 | Ruehl et al. |

*Primary Examiner*—Deborah Yee
(74) *Attorney, Agent, or Firm*—Andrus, Sceales, Starke & Sawall

(57) ABSTRACT

A conventional steel C-channel used as a side rail in a truck frame is strengthened by forming, after heat treating, strengthening lips on the edges of the C-channel flanges while the C-channel is still hot from the final tempering step of the heat treating process. The method obviates the need to use more expensive quenching dies and is advantageously performed immediately after tempering.

16 Claims, 1 Drawing Sheet

METHOD FOR STRENGTHENING A STEEL CHANNEL MEMBER

BACKGROUND OF THE INVENTION

The present invention pertains to a method for strengthening a structural steel channel member and, more particularly, to a method of forming strengthening lips on the end flanges of a channel member after the member has been heat treated.

High strength, low carbon steel channel members, sometimes referred to as C-channels, are widely used as the longitudinal side rails in the fabrication of truck frames. A typical C-channel includes a central web and a pair of parallel flanges extending perpendicularly from the opposite edges of the web. C-channels are typically cold rolled from a low carbon steel and then initially heated to develop a desired austenite grain structure which is converted to a martensite structure by rapid quenching in water, and then tempered to create a desired toughness. The foregoing process is particularly desirable for C-channel members used as side rails in heavy truck frames where steel having a tensile strength well in excess of 50,000 psi is required.

The rapid, high volume water quench used to convert the austenite grain structure to martensite is known to cause extreme distortion of the C-channel member. Such distortions may be removed after quenching, but the preferable method has been to utilize quenching dies that restrain the member from distortion while a high volume flow of water is directed through the die to all surfaces of the member. However, quenching dies are extremely costly and are only practical for use in very high volume standard steel sections.

It is also known that the stiffness and strength of a C-channel can be increased by forming a small lip on the free edge of each of the flanges. Such lips are formed by rolling or otherwise turning the edges of the flanges toward one another such that the lips extend generally perpendicular to the flanges. Although it would be possible to form strengthening lips on a C-channel in the initial cold rolling process from which the member is formed, such preformed sections would require even more complex and costly quenching tooling than a C-channel without preformed strengthening lips. This is because a typical quenching die utilizes a collapsible configuration that necessarily becomes even more complex when it must be constructed to accommodate the presence of in turned lips. Furthermore, because heavy truck manufacturers have varying size and gauge requirements for C-channels used as frame side rails, customized quenching dies would be required for each different size and gauge, a situation that would be completely cost-prohibitive.

SUMMARY OF THE INVENTION

In accordance with the present invention, a method is provided for forming strengthening lips on flanges of a channel member after heat treating. The preliminary heat treating comprises the steps of heating the member to an austenitizing temperature of at least about 1400° F.; quenching the member in a quenching die; and reheating the member to a tempering temperature of at least about 800° F., followed by the step of forming lips along the edges of the flanges while the member is still hot, preferably at or close to the tempering temperature.

The method of the present invention is particularly well suited for channel sections made from low carbon steels (having a carbon content in the range of about 0.20 to 0.30 weight percent). Such steels are amenable to heat treating as described above to tensile strengths in excess of 100,000 psi.

The preliminary austenitizing step is preferably performed at a temperature in the range of about 1400–1700° F. After quenching, the tempering step is preferably performed at a temperature in the range of about 800–1000° F. The final lip forming step is preferably performed at a temperature in the range of about 500–900° F., more preferably in the range of about 800–900° F.

The strengthening lips are preferably formed by rolling. The rolling step is preferably performed with a series of progressive rollers. The formed strengthening lips may extend from the flanges inwardly at an angle of about 90°, but an angle in the range of about 80° to 100° is satisfactory.

DETAILED DESCRIPTION OF THE PREFERRED EMBODIMENT

Figure 1:
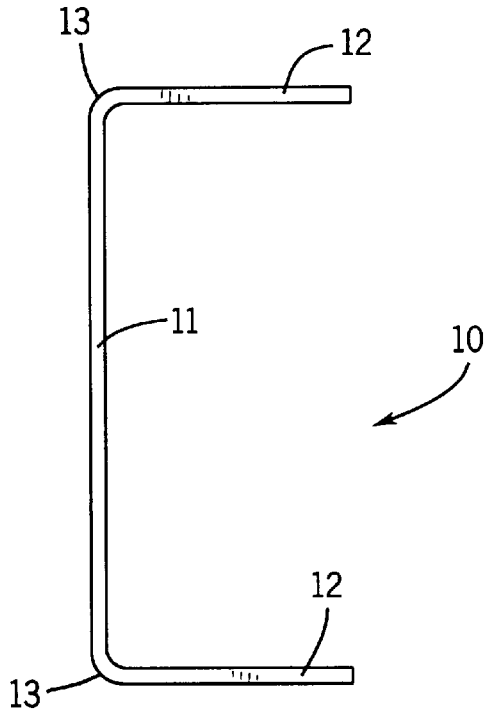
FIG. 1 is a cross sectional view through a conventional C-channel member.

A C-channel 10 of the prior art is shown in FIG. 1 and comprises a central web that interconnects a pair of end flanges 12 at radiused corners 13. As is well known in the art, a C-channel is formed by cold rolling a steel sheet with rollers to progressively form the finished cross section. The flanges 12 extend generally perpendicularly from the web 11 and the dimensions and thickness or gauge of the material may vary considerably depending on its final use. However, when used as a side rail in a heavy duty truck, the gauge of the material may be in the range of about 6 to 12 mm, the length of the side rails may be as great as 30–40 feet, and the section may have an overall height in the range of about 8 to 14 inches.

Although the C-channel could be used as initially formed, it is preferable particularly for heavy truck applications, to first heat treat the steel to increase its strength and to enhance other properties. Thus, the section is typically first heated to produce an austenite grain structure which, in low carbon steels, is preferably performed at a temperature in the range of about 1400–1700° F. The section is then rapidly quenched in a high volume water quenching die to convert the austenite grain structure to the preferred fine grained martensite structure. To minimize distortion during quenching, quenching dies have been developed to hold the section during quenching while accommodating normal shrinkage. Such a quenching die has a fairly complex construction, one such die being shown in U.S. Pat. No. 3,252,695, the disclosure of which is incorporated by reference herein. After quenching, the section is reheated to a tempering temperature, preferably in the range of about 800–1000° F., to reduce the brittleness and increase the ductility and toughness of the steel.

Figure 2:
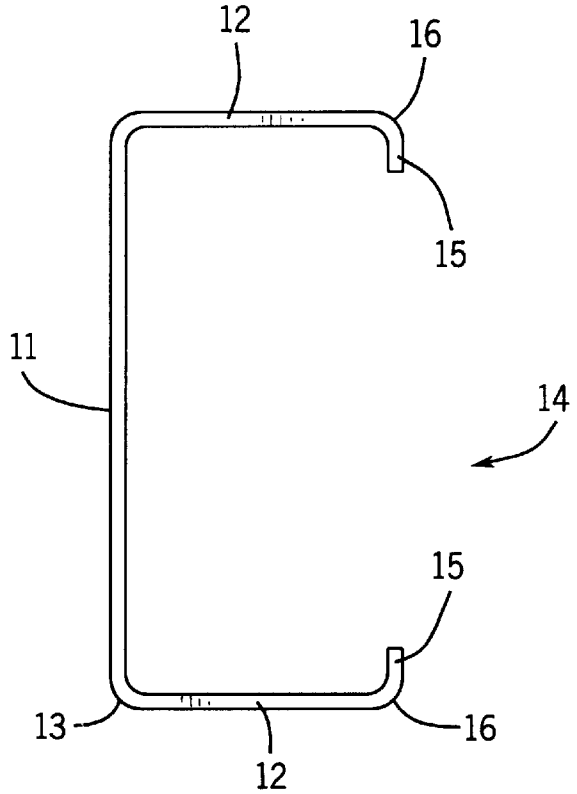
FIG. 2 is a cross sectional view through a lipped C-channel formed in accordance with the method of the present invention.

It is known that, for the same size and gauge of a section, a C-channel can be strengthened considerably by forming, as shown in FIG. 2, a lipped C-channel 14. The lipped C-channel 14 has a substantially greater stiffness and rigidity as compared to the simple C-channel 10 of FIG. 1. Thus, the use of a lipped C-channel 14 can provide a desired increase in side rail rigidity and, at the same time, provide the possibility of reducing the material gauge and therefore the weight of the member.

Although the conventional C-channel 10 of FIG. 1 may be quenched and simultaneously restrained against distortion utilizing quenching tooling of the type described in the above identified patent, the use of such tooling is impractical and/or prohibitively costly for a lipped C-channel 14 because of the increased complexity of the tooling and the wide range of dimensions utilized by the various heavy truck manufacturers. It is with this in mind that the method of the present invention forms the lips 15 on the C-channel 14 after heat treating has been completed using a conventional C-channel 10 and conventional quenching dies.

As indicated above, the final step in the conventional C-channel heat treating process is to temper the member by reheating it to a temperature of at least about 800° F. and, preferably, somewhere in the range of about 800–1100° F. In accordance with the present invention, the strengthening lips 15 are formed as the heat treated member exits the tempering furnace. At this point, the steel will be in a significantly softer state, making the formation of the strengthening lips 15 much easier with less chance of cracks occurring in the formed radii 16. Although the temperature of the C-channel 10 as it exits the tempering furnace will be greater than or close to at least 800° F., it is believed that strengthening lips 15 could be successfully formed at a temperature as low as about 500° F. It is a significant feature of the method of this invention that no separate heating step is required for forming the strengthening lips since they are formed immediately after tempering. Conventional progressive rolling dies are used in the presently preferred method of forming the lips 15.

As shown in FIG. 2, the lips are generally parallel to the web 11 and perpendicular to the flanges 12 on which they are formed. However, the lips 15 may be formed within a range of up to plus or minus 10° from a true perpendicular orientation of 90°. Thus, the strengthening lips 15 may have an angle with respect to the flange 12 in the range of about 80–100°. After the strengthening lips have been formed, the modified C-channel 14 is then allowed to air cool to ambient temperature.

Not only is the rigidity and strength of the lipped C-channel 14 substantially increased over the conventional C-channel 10 from which it is formed, the radiused comers 16 provide protection against potential edge breakout when the flanges 12 are punched for the connection of frame cross members or other frame attachments. Indeed, it is well known in the heavy truck industry that there is a reluctance to make connections of any kind through the flanges 12 of conventional C-channel side rails 10. Thus, the opportunity is provided to have a side rail of substantially increased strength without changing the material size or gauge and to adapt the improved channel to the use of improved connections and attachments not previously possible. For example, instead of attaching a frame cross member with two spaced connections through the web 11, two additional connections could be provided for the same cross member, one through each of the flanges 12.

I claim:

1. A method of forming strengthening lips on a low carbon steel channel member including a web and a pair of parallel flanges joined by the web, which member has been heat treated to produce a martensitic grain structure including the steps of rapid quenching of the member after heating to an austenitizing temperature, followed by reheating to an tempering temperature in the range of about 800 to 1000° F., said method comprising the additional step of:

forming lips, after tempering, along the edges of the flanges while the member is at a temperature of at least about 500° F.

2. The method as set forth in claim 1 wherein the step of quenching includes restraining the member against distortion.

3. The method as set forth in claim 1 wherein said forming step is performed at a temperature in the range of about 800 to 900° F.

4. The method as set forth in claim 1 wherein said lips are formed inwardly of the channel at an angle of about 90° to the flanges.

5. The method as set forth in claim 1 wherein the forming step comprises rolling.

6. The method as set forth in claim 1 including the additional step of air cooling the formed member to ambient temperature.

7. A method of strengthening a low carbon steel channel member of the type having a pair of generally parallel end flanges joined by a central web, comprising the steps of:

(1) heating the member to an austenitizing temperature of at least about 1400° F.;

(2) quenching the member with a turbulent flow of water while restraining the member in a quenching die;

(3) reheating the member to a tempering temperature of at least about 800° F.; and, (4) forming lips, aftering tempering, along the edges of the flanges while the member is at a temperature greater than about 500° F.

8. The method as set forth in claim 7 wherein the austenitizing temperature is in the range of about 1400 to 1700° F.

9. The method as set forth in claim 7 wherein the tempering temperature is in the range of about 800 to 1100° F.

10. The method as set forth in claim 7 wherein the forming temperature is in the range of about 500 to 900° F.

11. The method as set forth in claim 7 wherein the forming temperature is in the range of about 800 to 900° F.

12. The method as set forth in claim 7 wherein the forming step comprises rolling.

13. The method as set forth in claim 12 wherein the rolling step is performed with series of progressive rollers.

14. The method as set forth in claim 7 wherein the lips are formed to extend from the flanges inwardly at an angle of about 90°.

15. The method as set forth in claim 7 wherein the lips are formed to extend from the flanges inwardly at an angle in the range of about 80° to 100°.

16. The method as set forth in claim 7 wherein the forming step is performed while the member is at the tempering temperature.

* * * * *